US006712060B2

(12) United States Patent
Egusquiza

(10) Patent No.: US 6,712,060 B2
(45) Date of Patent: Mar. 30, 2004

(54) ARCHERY BOW STRING LOOP RELEASE ACCESSORY

(75) Inventor: Ralph R. Egusquiza, Midvale, ID (US)

(73) Assignee: Archery Technologies Inc., Payette, ID (US)

( * ) Notice: Subject to any disclaimer, the term of this patent is extended or adjusted under 35 U.S.C. 154(b) by 0 days.

(21) Appl. No.: 10/226,543

(22) Filed: Aug. 23, 2002

(65) Prior Publication Data

US 2004/0035406 A1 Feb. 26, 2004

(51) Int. Cl.[7] ..... F41B 5/00
(52) U.S. Cl. ..... 124/91
(58) Field of Search ..... 124/90, 91

(56) References Cited

U.S. PATENT DOCUMENTS

| | | | | | |
|---|---|---|---|---|---|
| 2,133,650 | A | | 10/1938 | Baker | 124/35 |
| 3,656,467 | A | | 4/1972 | Halter | 124/35 |
| 3,714,316 | A | * | 1/1973 | Angeloff | |
| 3,768,456 | A | | 10/1973 | Hansen et al. | 124/35 A |
| 4,702,067 | A | * | 10/1987 | Izuta | |
| 4,724,821 | A | | 2/1988 | Besaw | 124/35 A |
| D374,265 | S | | 10/1996 | Rasmussen | D22/107 |
| 5,904,135 | A | * | 5/1999 | Summers et al. | 124/91 |
| 6,302,093 | B1 | | 10/2001 | Holland | 124/35.2 |

* cited by examiner

*Primary Examiner*—John A. Ricci
(74) *Attorney, Agent, or Firm*—Joseph W. Holland

(57) ABSTRACT

A bow string loop release including a flexible strand having two opposing and spaced-apart loop ends connected by a durable center release engagement portion. The preferred bow string loop release includes a center release engagement portion formed of a resilient, tough yet pliable strand or construction. The opposing first and second loop ends are formed of a material or by a method that results in a loop end sufficiently pliable to permit configuration of the first and the second loop ends as first and second slip hitches for securing the bow string loop release to a bow string.

3 Claims, 6 Drawing Sheets

ARCHERY BOW STRING LOOP RELEASE ACCESSORY

BACKGROUND

1. Field the Invention

This invention relates generally to archery and bow-hunting equipment, and, more especially, to devices for aiding the release of a bow string. The present invention relates to a device for connecting a trigger-style release aide to a bow string.

2. Related Art

Many devices have been developed for facilitating the smoothness and evenness of a drawn bow string in archery and bow-hunting. One category of such devices has a rigid hook or other rigid retaining member that the user places partially around the bow string in a position that will allow the archer to pull the bow string back by pulling on the hook/retaining member. After the archer draws the bow string by pulling on the rigid hook/retaining member and aims, he turns or otherwise moves the hook/retaining member to allow the bow string to slide out of the hook/member, thus releasing the bow string. Such rigid hook devices tend to have the negative characteristics of producing unpredictable and irreproducible results, and an increased change of hook slippage and the consequent premature firing of the arrow. Further, the direct contact and relative movement between the rigid hook and the bow string, tend to increase wear and damage of the bow string. Examples of such rigid hook/retainer devices are Baker, U.S. Pat. No. 2,133,650, issued June 1937; Halter, U.S. Pat. No. 3,656,467, issued April 1972; Hansen, et al., U.S. Pat. No. 3,768,456, issued Oct. 30, 1973; and Holland, U.S. Pat. No. 6,302,093, issued Oct. 16, 2001.

Another category of string release device is the rope-style device. Such devices include a string or rope member that is placed around the bow string such as is shown in Besaw (U.S. Pat. No. 4,724,821, see FIG. 3 for loop not wrapped around the bow string). The loop is anchored at its proximal end on a handle, and wrapped around the bow string so that the loop extends from the handle, around the bow string, and back to the handle, resulting in two portions of rope extending around the bow string, as shown in Besaw, FIGS. 1 and 2. To fire the arrow, the user lets go, or operates the handle to let go, of the distal end of the loop, thereby releasing the bow string.

A third category of release device is the trigger-style release aide. A particularly popular version of the trigger-style release aide includes a handle and trigger portion from which extend two jaws adapted to clamp around the bow string. After the user pulls back on the release aide with the captured bow string in its jaws, he/she simply pulls the "trigger," which snaps open the jaws and releases the bow string.

The trigger-style aide is popular because of the jaws grasp securely around the bow string and because of the ease and predictability of the trigger release. Still, archers have developed accessories that improve the convenience of operation of the trigger-style release aide, and that attempt to alleviate wear and tear on the bow string caused by the jaws. One such accessory is a rigid metal U-shaped device that is bolted onto the bow string, as in FIG. 1A. Such an accessory provides an alternative member around which the jaws may clamp, preventing wear directly on the bow string due to movement of the bow string relative to the jaws. This U-shaped accessory, however, is made of metal and significantly "weighs down" the bow string, reducing its velocity and, therefore, reducing the velocity of the arrow. The effect of this U-shaped accessory on the bow string has been measured at about 11 feet/seconds velocity reduction.

Archers themselves have constructed another accessory for trigger-style release aides, by tying a length of bow string material onto their bow string in a loop. Such an accessory is shown in FIG. 1B. The archer knots each of the two ends of the string onto the bow string about two inches apart, so that a small loop extends from the bow string for clamping by the jaws. This "home-made" accessory may work for some time, but it offers the real danger of one or both knots letting go during drawing or aiming. If this happens, the get forces involved tend to throw the user's fist and the release aide backwards at the user, most likely at his/her face, resulting in significant injury.

Therefore, there is still a need for a bow string release system that is convenient, lightweight, and safe. There is a need for such a system that may operatively attach to the bow string for repeated use with little or no wear and tear of the bowstring. The present invention meets these and other needs.

SUMMARY

A bow string loop release including a flexible strand including two opposing and spaced-apart loop ends connected by a durable center release engagement portion. The preferred bow string loop release, includes a center release engagement portion formed of a resilient, tough yet pliable element or construction. The opposing first and second loop ends are formed of a material or by a method that results in a loop end sufficiently pliable to permit configuration of the first and the second loop ends as first and second slip hitches for securing the bow string loop release to a bow string.

In one preferred embodiment of the invention, the bow string loop release includes a loop, which is preferably formed of a continuous length of string coiled several times into a circular or oval form. Preferably, the continuous length of string is configured as a multiple filament string. In one preferred embodiment, the string is coiled in a figure "8" pattern rather than a circular or oval pattern before a binding string is wound around the coil. It has been observed that this method may provide a main loop that is particularly durable and exhibits consistent performance.

The coil is pinched together in the center forming opposing loop ends and a binding string is wound around the center release engagement portion forming windings to reinforce the center release engagement portion of the coil and form an elongated, firm center release engagement portion. Thus, the bow string loop release takes the form of an elongated bound center release engagement portion with a loop end extending at either end of the elongated bound center release engagement portion. This structure results in a long-lasting bow string loop release, wherein the ends tend to cling in place on the bow string, rather than slide down the bow string. The center release engagement portion is firm, although somewhat bendable, and is easily clamped by the release aide jaws.

In order to place the bow string loop release on the bow string, the two loop ends are reversed back upon the elongated bound center release engagement portion to form first and second slip hitches. An end of the bow string is threaded through the first and second slip hitches and tightened into a selected position by pulling on the elongated bound center release engagement portion, thereby tightening the first and second slip hitches.

The preferred construction of the bow string loop release provides a firm but still slightly flexible bow string loop release. After being bent into an approximate half circle, it tends to stay in that shape, but is non-brittle and durable. The center release engagement portion is received between the release aide jaws securely enough for the release aide to pull the bow string loop release, and, hence, the bow string, back during drawing of the bow. The bow string loop release is intended primarily for use with a trigger-style release device, although there may be advantage in using the bow string loop release to provide a gripping point for an archer's fingers or other pulling means. When using a trigger-style release device, the release jaws clamp around the bow string loop release, rather than around the bow string. A desired pulling force is applied the bow string via the bow string loop release. After aiming, the archer operates the trigger to open the jaws, releasing the bow string loop release, and hence the bow string, to fire the arrow. The bow string loop release may provide a smoother, more predictable, and more accurately angled, and non-damaging release of the bow string after drawing and aiming.

A method for making a bow string loop release includes forming a relatively flexible strand including a center release engagement portion, the flexible strand also including a first loop end extending from a first end of the center release engagement portion and a second loop end attached to and extending from a second end the center release engagement portion. The first and second loop ends may be configured as first and second slip hitches.

In one embodiment the method for making a bow string loop release includes the steps of:

forming a loop of a relatively pliable material;

applying a compressive force at opposing loop points forming a pinched center loop portion resulting in the formation of a first loop end attached to and extending from a first end of the pinched center loop portion and a second loop end attached to and extending from a second end the pinched center loop portion; and forming a center release engagement portion a resilient pliable covering is applied to the pinched center loop portion forming a center release engagement portion.

The method for making a bow string loop release may also include the additional steps of:

forming the loop by wrapping 5 to 8 wraps of string having a diameter in the range of 0.010 to 0.050 inches to form a coil defining the loop; and wrapping a binding string having a diameter in the range of 0.010 to 0.050 inches to form the binding wrap around the pinched center loop portion forming the center release engagement portion.

The method for making a bow string loop release may also include the additional steps of:

wrapping a first end of the binding string under successive binding wraps;

capturing a second end of the binding string employing a capture device;

pulling the second end of the binding string back under the last few successive binding wraps; and attaching the second end of the binding string to one or more binding wraps.

The present invention consists of the devices and methods hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

DRAWINGS

Figure 13:
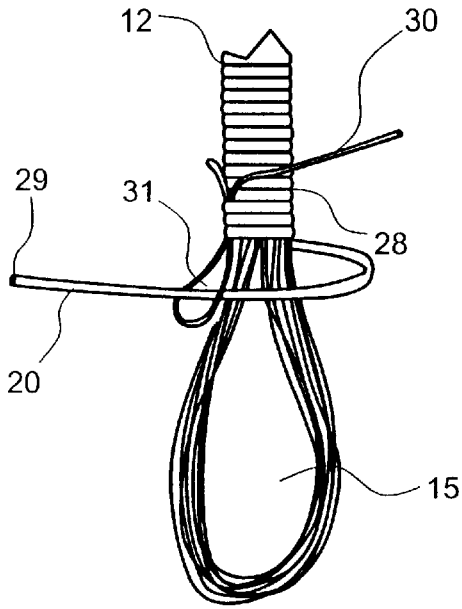
Figure 14:
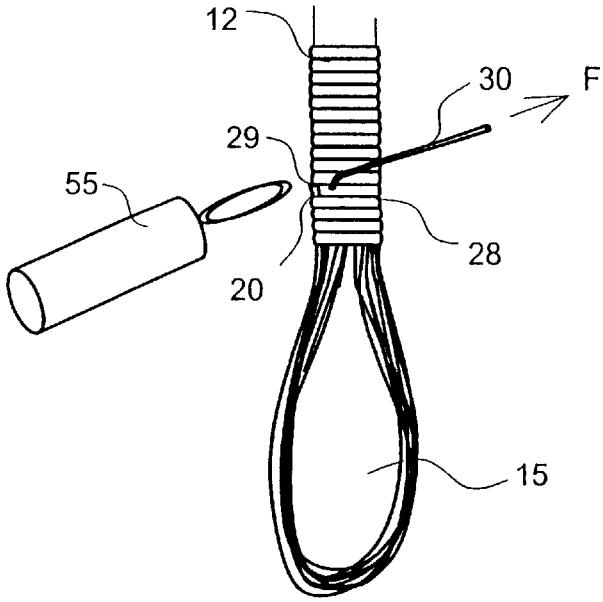
Figure 15:
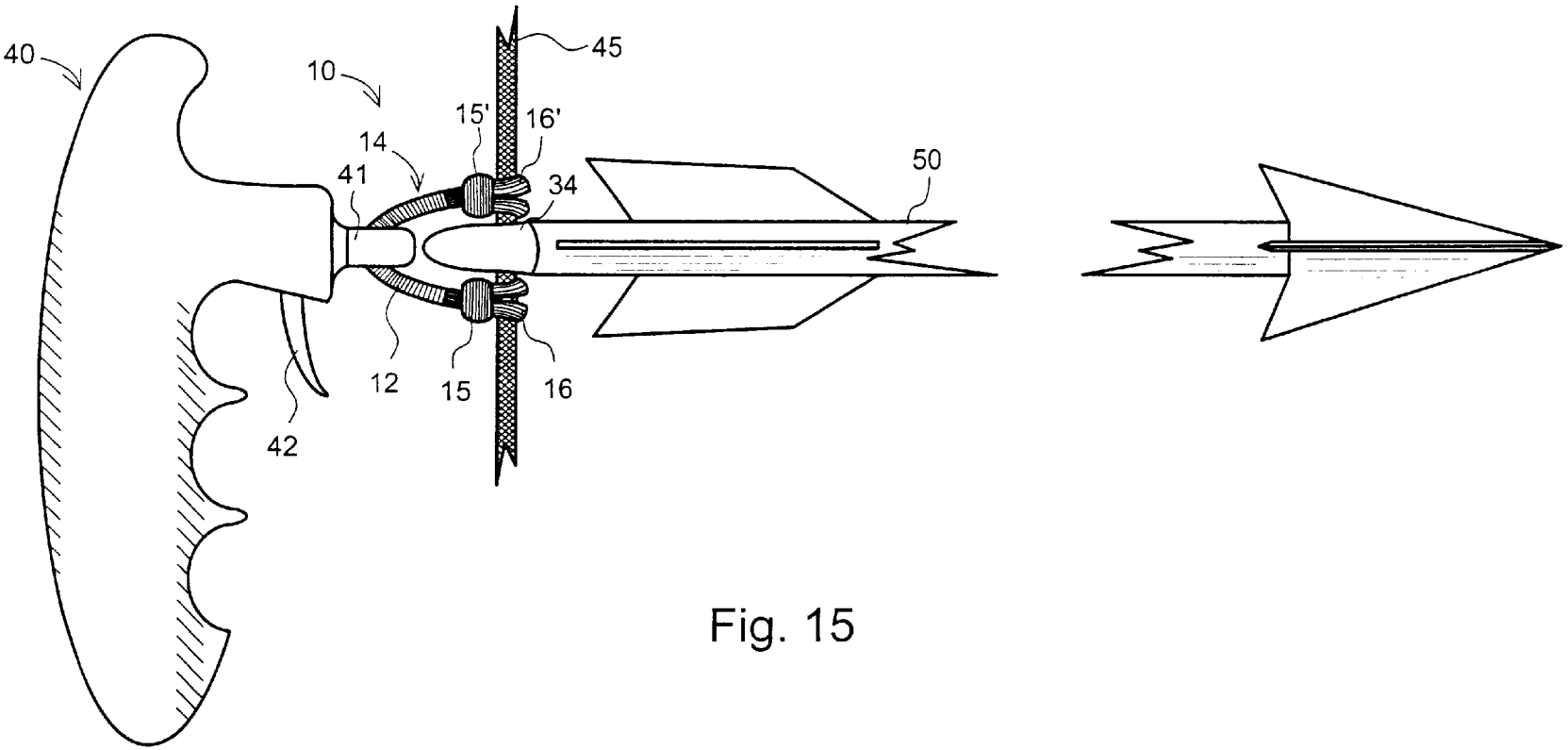
Figure 16:
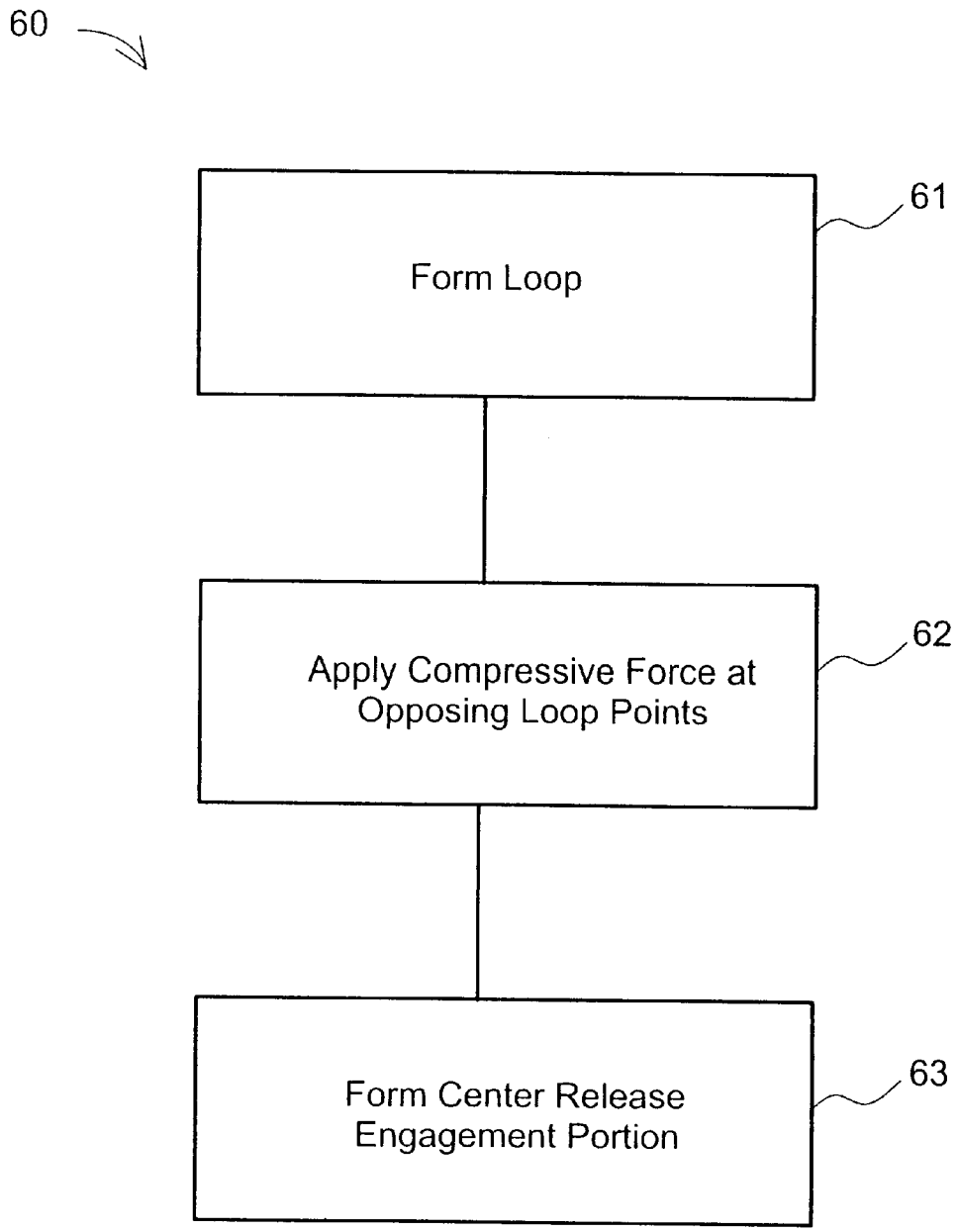

FIGS. 13 and 14 are details showing one preferred method for using a temporary loop to capture a second end of the binding string under the last few wraps in one preferred method for manufacturing a string release accessory; and FIG. 15 is a representative side view of a string release accessory installed on a bow string, clamped by a string release aide, and supporting an arrow nock; and FIG. 16 is a representative schematic diagram depicting the steps of a method for making a bow string loop release.

DETAILED DESCRIPTION

Figure 1A:
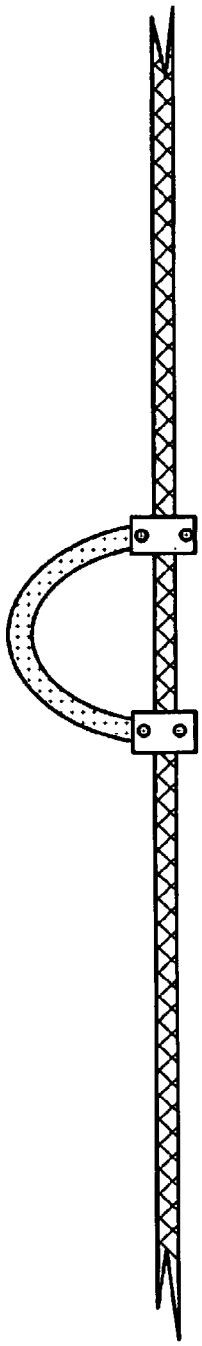
Fig. 1A (Prior Art)
FIG. 1A is a prior art accessory for a trigger release aide, which is a metal U-shaped member bolted onto a bow string.
Figure 1B:
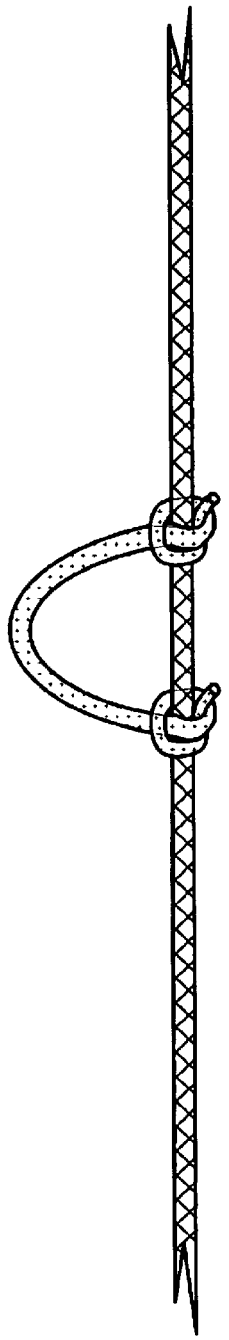
Fig. 1B (Prior Art)
FIG. 1B is a prior art accessory for a trigger release aide, which is a single string tied at both ends to a bow string.
Figure 2:
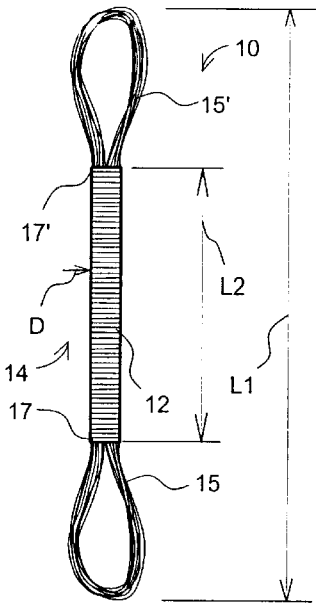
FIGS. 2 through 5 are representative side views of one embodiment of a string release accessory.
Figure 3:
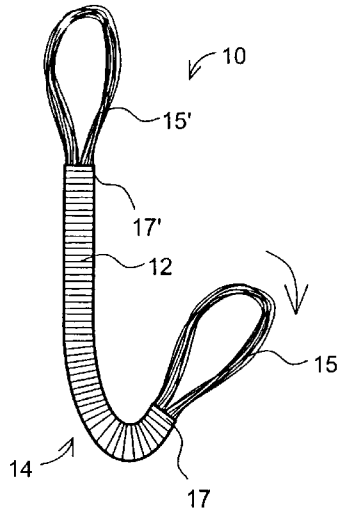
Figure 5:
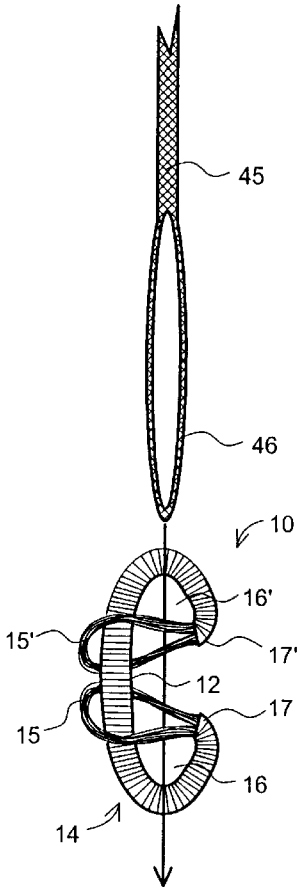
Figure 4:
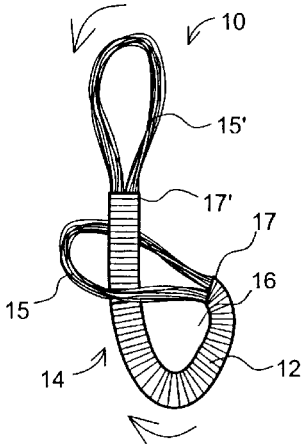
Figure 6:
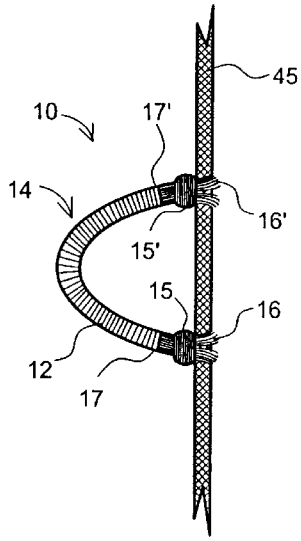
FIG. 6 is a representative side view of a string release accessory shown attached to a bow string.

Referring to FIGS. 2–6 and 15, bow string loop release 10 formed as a resilient strand 14 including center release engagement portion 12 having first end 17 and a second end 17'. Bow string loop release 10 also includes first and second loop ends 15 and 15' respectively. Loop ends 15 and 15' extend from first end 17 and a second end 17' of center release engagement portion 12. First and second slip hitches 16 and 16' are formed in first and second loop ends 15 and 15' respectively. As shown in FIGS. 3 through 5, first loop end 15 is reversed back along center release engagement portion 12 to form first slip hitch 16 as shown in FIG. 4. Second loop end 15' is reversed back along center release engagement portion 12 forming second slip hitch 16' as shown in FIG. 5. Bow string 45 is passed through first and second slip hitches 16 and 16' formed in loop ends 15 and 15' respectively as seen in FIG. 5. As shown in FIG. 6, first and second slip hitches 16 and 16' are tightened securing bow string loop release 10 at a selected position along the length of bow string 45.

Figure 7:
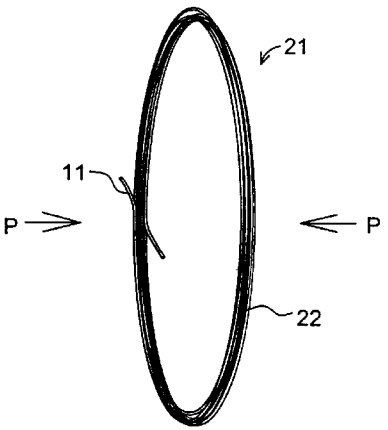
FIGS. 7 through 9 depict one preferred method for manufacturing a string release accessory.
Figure 8:
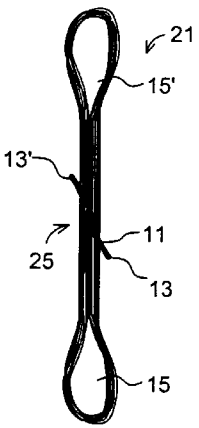
Figure 9:
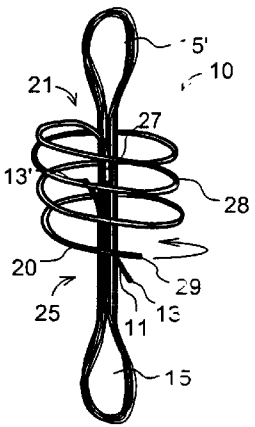

Referring to FIGS. 7–9 a first method for making bow string loop release 10 is shown. A plurality of circular or oval wraps 22 are formed of string 11 which is wrapped continuously to form coil 21.

In one preferred embodiment, shown in FIG. 7, continuous coil 21 of string 11 is wound continuously to form plurality of wraps 22 which are formed as a circular or oval configuration. In an alternate preferred embodiment, shown in FIG. 10, a continuous coil 23 of string 11 is wound continuously to form plurality of wraps 24 which are formed as a plurality of figure 8's. In either of the methods shown in FIGS. 7–9 or FIGS. 10–12, a string 11 is wrapped continuously to form at least one and one half wraps, although as many wraps 22 or 24 are formed as required to present the desired finished diameter D, as shown in FIG. 2, for center release engagement portion 12. Referring to FIGS. 7–9, coil 21 includes preferably, 3–8 circular or oval wraps 22, and more preferably 5 circular or oval wraps 22, when using the preferred string 11, such as BCY 450, by BCY Incorporated, of North Haven, Conn., which is a waxed string that is 21/1000 inch thick. Similarly, referring to FIGS. 10–12, coil 23 includes preferably, 3–8 FIG. 8 wraps 24, and more preferably 5 FIG. 8 wraps 24, when using the preferred string material, such as BCY 450. Alternatively, other strings or continuous filaments maybe used, such as BCY 452, BCY 451, BCY 8125, or other preferably, multi-filament materials. Alternately other strings having other diameters may be used simply adding or subtracting wraps 22 or 24 to arrive at a desired diameter. For instance, string 11 may have a diameter in the range of 0.010 to 0.050 inches.

Figure 10:
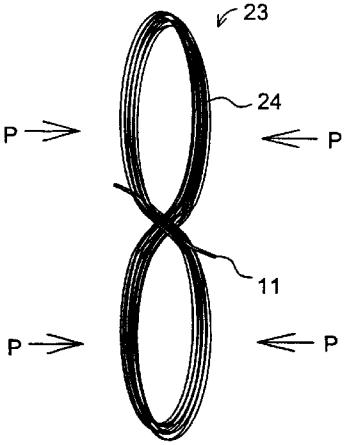
FIGS. 10 through 12 depict one preferred method for manufacturing a string release accessory.
Figure 11:
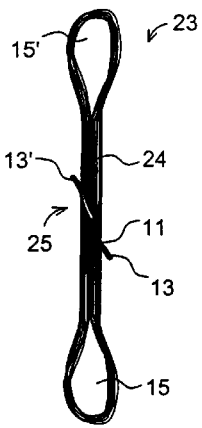

In FIGS. 7 and 10, pressure is applied as shown by arrows P forming pinched center portion 25, as shown in FIGS. 8 and 11. The result, as shown in FIGS. 9 and 12, is a configuration including opposing loop ends 15 and 15' respectively joined by pinched center portion 25.

Figure 12:
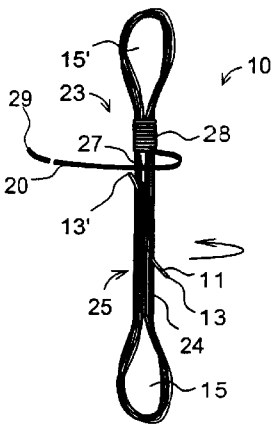

Referring to FIGS. 9 and 12, pinched center portion 25 is covered tightly with binding string 20 for retaining coil 21 and 23 respectively. Binding string 20 reinforces string 11, which forms coil 21 or 23, at center release engagement portion 12, and provides a tough and durable center release engagement portion 12 that may be repeatedly clamped by jaws 41 of the release aide 40, as seen in FIG. 15. Binding string 20 provides a reinforced, tough and durable center release engagement portion 12 that may be repeatedly clamped by jaws 41 of the release aide 40, as seen in FIG. 15.

Binding string 20 may be wrapped as shown in FIG. 9, in loosely separated binding wraps 28, but the preferred method, as seen in FIG. 12, includes wrapping each binding wrap 28 very tightly around pinched center portion 25. First end 27 of binding string 20 is laid against pinched center portion 25 and binding string 20 is wrapped around pinched center portion 25 so as to secure first end 27 underneath the plurality of binding wraps 28. Once the plurality of binding wraps 28 form a reinforced center release engagement portion 12 of the desired length L2, as shown in FIG. 2, second end 29 is secured by being threaded back toward first end 27 of binding string 20, underneath several binding wraps 28. This may be done by placing thread 30 including temporary loop 31, as seen in FIGS. 13 and 14, under the last few binding wraps 28, and using temporary loop 31 to capture second end 29 of binding string 20 and pull it back under the last few wraps 28 by applying pulling force F to thread 30 pulling second end 29 out from between adjacent wraps 28 as seen in FIG. 14. The exposed second end 29 is flame sealed or fused to binding string 20 using heat source 55, such as a match or other heat source, to melt second end 29 which is then flattened and stuck to wraps 28.

As seen in FIGS. 8, 9, 11 and 12, string ends 13 and 13' are preferably terminated along pinched center portion 25 to assure that string ends 13 and 13' are well anchored beneath binding string 20 as it is applied. The preferred material for binding string 20 is a material identified as, 62 Braided Serving, manufactured by BCY Incorporated. As seen in FIGS. 9 and 11 approximately 30–50 binding wraps 28 are made with binding string 20 about pinched center portion 25 forming center release engagement portion 12. Binding string 20 may have a diameter in the range of 0.010 to 0.050 inches and more preferably binding string 20 may have a diameter substantially equal to 0.021 inches.

For conventional bows and bow strings, the preferred string release accessory 10 includes an overall length L1, as shown in FIG. 2, in the range of 2 to 3 inches and more preferably equal to 2½ inches plus or minus ¼ of an inch, and more preferably an overall length L1 substantially equal to 2½ inches. Similarly, the preferred string release accessory 10 includes a center release engagement portion 12 including a length L2, as shown in FIG. 2, in the range of ½ to 1½ inches more preferably equal to ⅓ to ½ of length L1 of string release accessory 10, and more preferably substantially equal to 1 inch. Additionally, a preferred string release accessory 10 includes a diameter D along center release engagement portion 12, as shown in FIG. 2, in the range 1/16 to 3/16 of an inch and more preferably equal to ⅛ of an inch plus or minus 1/16 of an inch, and more preferably a diameter D substantially equal to ⅛ inch. This results in a string release accessory 10 that fits a conventional arrow nock curving out away from bow string 45 as seen in FIG. 15 for engagement by jaws 41 of release aide 40.

To attach bow string loop release 10 to bow string 45 as seen in FIGS. 6 and 15, bow string 45 is detached or left unattached from the bow and a first end 46 of bow string 45, shown in FIG. 5. First end 46 of bow string 45 is passed through or threaded through first and second slip hitches 16 and 16', as shown in FIG. 5. String release accessory 10 is slid up to the region of bow string 45 that marks the location of the top of the arrow nock 34, which is often represented on the bow string by a "top tie," and bow string loop release 10 is pulled to tighten second slip hitch 16' on bow string 45. First slip hitch 16 is then positioned about ½ inch from second slip hitch 16', and then tightened on bow string 45.

Jaws 41 of release aide 40 are closed around center release engagement portion 12 of string release accessory 10 and pull may be applied to bow string 45 via string release accessory 10. In the alternative, pull may be manually applied to bow string 45 via string release accessory 10 by simply grasping center release engagement portion 12 between two fingers. In either case, application of a pulling force to string release accessory 10 further serves to tighten first and second slip hitches 16 and 16'.

During aiming, nock 34 of the arrow 50 is placed between first and second slip hitches 16 and 16'. Trigger 42 is actuated to open jaws 41, thereby releasing string release accessory 10 and bow string 45 to fire arrow 50.

Referring to FIG. 16, a "Method for Making a Bow String Loop Release" 60 includes the steps of Form Loop 61 wherein a loop is formed of a relatively pliable material. At "Apply Compressive Force to Opposing Loop Points" 62, a pinched center loop portion is formed by applying a compressive force to opposing points located along a periphery of the loop. This results in the formation of a first loop end attached to and extending from a first end of the pinched center loop portion and a second loop end attached to and extending from a second end the pinched center loop portion. At "Form Center Release Engagement Portion" 63, a resilient pliable covering is applied to the pinched center loop portion forming a center release engagement portion.

Various modifications to the described embodiments as well as the inclusion or exclusion of additional embodiments will be apparent to persons skilled in the art upon reference to this description. It is therefore contemplated that the appended claims will cover any such modifications or embodiments as fall within the true scope of the invention.

I claim:

1. A method for making a bow string loop release including the steps of:

forming a relatively flexible strand by forming a loop of a relatively pliable material including a center release engagement portion, the flexible strand also including a first loop end extending from a first end of the center release engagement portion and a second loop end attached to and extending from a second end the center release engagement portion;

applying a compressive force to opposing points located along a periphery of the loop forming a pinched center loop portion, a first loop end attached to and extending from the pinched center loop portion and a second loop end attached to and extending from a second end the pinched center loop portion; and wrapping a binding wrap around the pinched center loop portion forming a center release engagement portion.

2. The method for making a bow string loop release of claim 1 including the additional step of:

forming the loop by wrapping 5 to 8 wraps of string having a diameter in the range of 0.010 to 0.050 inches to form a coil defining the loop;

wrapping a binding string having a diameter in the range of 0.010 to 0.050 inches to form the binding wrap around the pinched center loop portion forming the center release engagement portion.

3. The method for making a bow string loop release of claim 1 including the additional step of:

wrapping a first end of the binding string under successive binding wraps; and capturing a second end of the binding string employing a capture device;

pulling the second end of the binding string back under the last few successive binding wraps; and attaching the second end of the binding string to one or more binding wraps.

* * * * *